US008077555B1

(12) United States Patent
Lovato

(10) Patent No.: US 8,077,555 B1
(45) Date of Patent: Dec. 13, 2011

(54) SPONGE REPLACEMENT AND REMINDER SYSTEM AND METHOD

(76) Inventor: Wendy Lovato, Las Vegas, NV (US)

( * ) Notice: Subject to any disclaimer, the term of this patent is extended or adjusted under 35 U.S.C. 154(b) by 0 days.

(21) Appl. No.: 12/824,332

(22) Filed: Jun. 28, 2010

(51) Int. Cl.
*A47K 7/02* (2006.01)

(52) U.S. Cl. ..... 368/327; 15/244.4

(58) Field of Classification Search ..... 368/10, 368/327; 15/244.4
See application file for complete search history.

(56) References Cited

U.S. PATENT DOCUMENTS

| | | | | |
|---|---|---|---|---|
| 2,489,707 | A * | 11/1949 | Eubanks | 206/361 |
| 2,819,482 | A * | 1/1958 | Applegate | 15/110 |
| D182,116 | S * | 2/1958 | Gray | D32/43 |
| 6,000,159 | A * | 12/1999 | Hornung | 40/307 |
| 6,095,324 | A * | 8/2000 | Mullin | 206/204 |
| 6,226,961 | B1 * | 5/2001 | Gordon | 53/445 |
| 7,297,834 | B1 | 11/2007 | Shapiro | |
| 2003/0121117 | A1 | 7/2003 | Isenberg | |
| 2004/0182733 | A1 * | 9/2004 | Dunlap | 206/459.1 |
| 2005/0211585 | A1 * | 9/2005 | Wallace | 206/362.2 |
| 2008/0155868 | A1 * | 7/2008 | DeGennaro | 40/314 |

OTHER PUBLICATIONS

How to sanitize—ehow.com/how_4609861)sanitize-dish-sponge.html; Aug. 12, 2008; Source archive.org; May 2, 2011.*

* cited by examiner

*Primary Examiner* — Sean Kayes
(74) *Attorney, Agent, or Firm* — The Law Firm of Andrea Hence Evans, LLC

(57) ABSTRACT

A method and system for identifying when a cleaning article, such as a sponge, should be replaced or disposed within a period of time is disclosed. A cleaning article such as a sponge is labeled with a time increment that will act as an expiration date or reminder for the user. The time increment may be in month increments that can be abbreviated or spelled. At the end of the time increment, the user will be reminded that he has used the sponge longer than the time increment by seeing the time increment on the sponge. The sponge will be replaced with a sponge having a new time increment.

5 Claims, 2 Drawing Sheets

SPONGE REPLACEMENT AND REMINDER SYSTEM AND METHOD

FIELD OF THE INVENTION

The present invention relates to identifying cleaning articles, such as sponges, that should be replaced or disposed within a period of time.

BACKGROUND OF THE INVENTION

Cleaning articles such as sponges and dishrags are used to clean various surfaces. Using a sponge to wipe up spills and clean is one of the most used methods for a quick clean up. However, sponges can hold literally billions of bacteria. Bacteria colonies with a total population exceeding 50 million can live on a single dirty sponge. Research shows that sponges and dishrags should be replaced at least once a month. Methods such as bleaching, microwaving and boiling sponges are used to attempt to clean or disinfect sponges. However, even the best disinfectant cannot remove all of the food particles, debris, germs and bacteria that are found on sponges. Despite this, users tend to use a single sponge longer than the recommended use causing cross contamination and illness.

SUMMARY OF THE INVENTION

The present invention discloses a method and system for identifying when a cleaning article, such as a sponge, should be replaced or disposed within a period of time.

An aspect of an embodiment of the invention provides a time indicia labeled on the sponge that will identify when the sponge should be replaced at the end of the time period.

A further aspect of an embodiment of the invention provides aid in replacing a sponge at least once a month to prevent sickness and the spread of harmful bacteria.

A further aspect of an embodiment of the invention provides a method to identify how long a sponge is used pass its recommended usage time.

Additional aspects, objectives, features and advantages of the present invention will become apparent from the following description of the preferred embodiments with reference to the attached drawings.

DETAILED DESCRIPTION OF THE INVENTION

Figure 1:
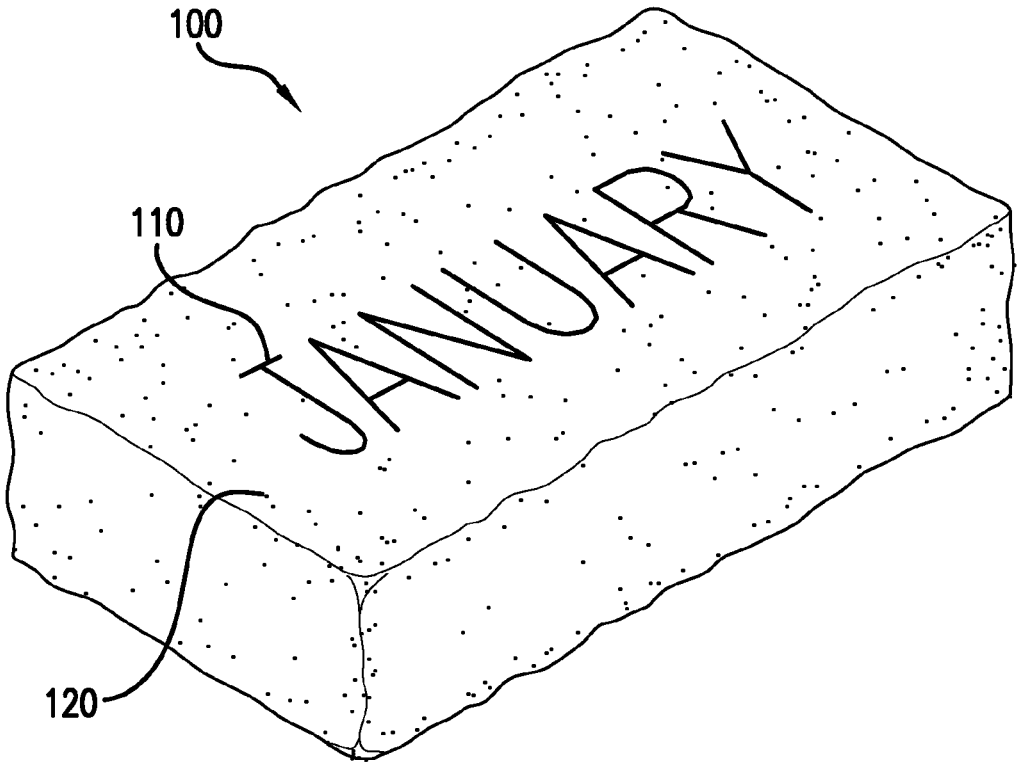
FIG. 1 is a perspective view of a sponge having a time increment indicia.
Figure 2:
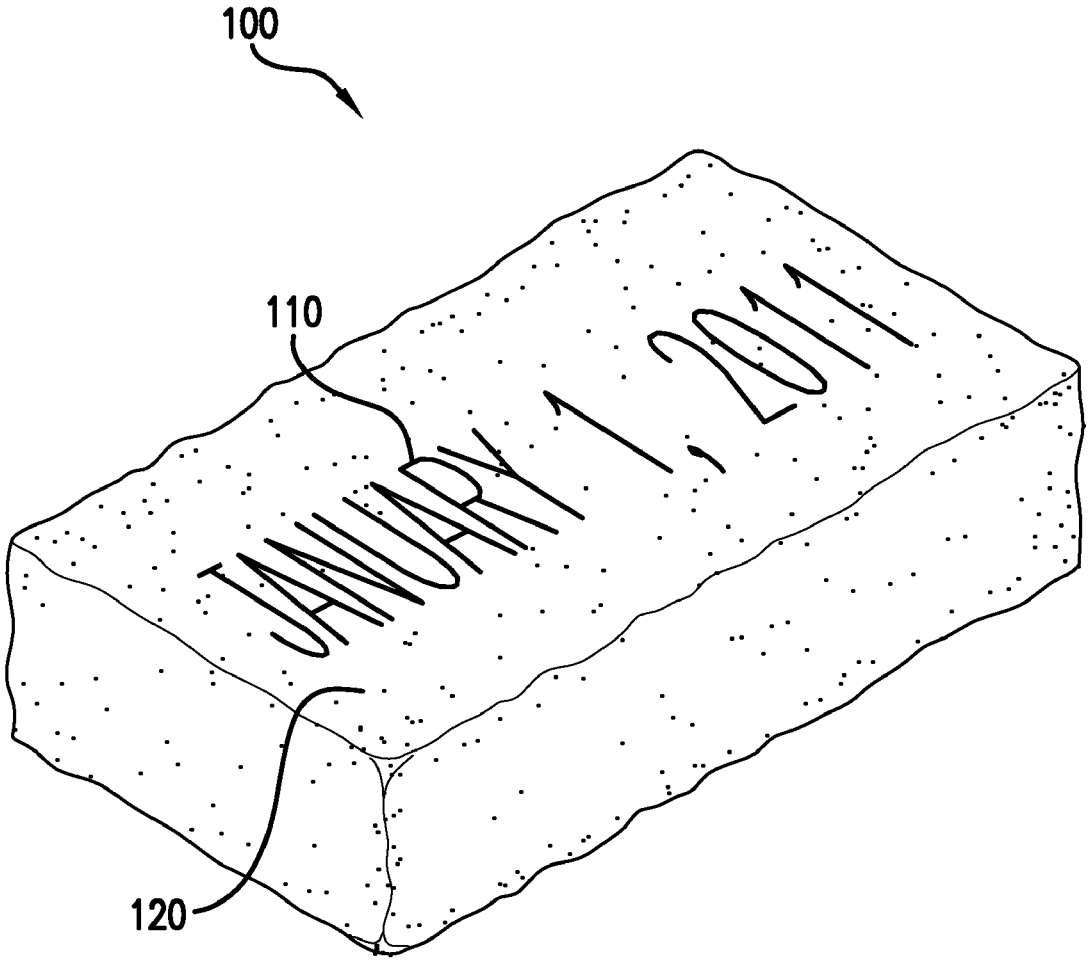
FIG. 2 is a perspective view of a sponge having a time increment indicia shown in a date format.

FIG. 1 is a perspective view of a sponge 100 having a time increment indicia or identifier 110. One sponge is shown in FIG. 1 for illustration purposes: however, the sponge may belong to a set of multiple sponges. The sets may feature a variable number of sponges equal to the time increment specified on the sponge. For example, if the user desires to change the sponge daily, the set would comprise seven sponges since there are seven days in a week. If the user desires to replace the sponge weekly, the set may include fifty two sponges since there are 52 weeks in a year. If monthly disposal is desired, the set may include 12 sponges since there are twelve months in a year, and so on. Each sponge 100 has indicia 110 on at least one exterior surface 120 of the sponge 100 that represent a time increment or time period. The time increment may be a day, month, week or be shown in a date format such as month/day/year as shown in FIG. 2. Also, the time increment may be a combination of various time periods such as month and year, month and day or day and year, for example. The time increment is shown in a consecutive order on the sponges. If the time increment is monthly, the sponges' indicia would be January, February, March, April, etc. If daily, the sponges would read Monday, Tuesday, Wednesday, etc. The text on the sponge may also be shown in a foreign language.

If it is the month of January, the user would use a first sponge from the set of multiple month sponges whose indicia reads JANUARY. When February arrives the user would replace or dispose of the JANUARY sponge and use a second sponge whose indicia reads FEBRUARY. The third sponge used will be the MARCH sponge in this example. Although the description describes a user using a sponge in the month of January, the invention provides indicia on the sponge for time periods so if the user uses his first sponge in a different month, the user should use the sponge whose indicia illustrates the month or time period of the actual use. The time increment on the set of multiple sponges indicates a time when each sponge in the set of sponges should be used.

The text may be fully spelled out as shown in FIG. 1 or the text may be abbreviated such as JAN. for JANUARY, and so on. The time increment may be written with alphabetical symbols or numeric symbols. Each sponge has a different and unique time increment. The sponge 100 is shown in a rectangular shape; however, the sponges may be any geometric shape, color or size. The font of the indicia may be larger or smaller.

The indicia indicates the time period to use the sponge or when to dispose of the sponge at the end of the time period. The sponge should not be used after the end of the time period. It should be replaced with a new sponge that identifies the time period of actual use. The time period coincides with an actual time period the sponge is in use. The sponge should be replaced with a different sponge if the time period is not the time period the sponge is currently being used. The JAN sponge should be used in January. The FEB sponge should be used in February, and so on. The Monday sponge should be used on Monday.

The identification system may be applied to any type of sponge. The preferred sponge is a porous multipurpose sponge. The indicia may be applied by known application methods such as printing, dyeing or stamping methods. The ink or paint applied should be semi-permanent or permanent.

The indicia on the sponge will act as an expiration date. Psychologically, it will be difficult for a user to continue to use a sponge longer than the time period indicated on the sponge. The user can identify how long a sponge is used pass its recommended usage time based on the indicia on the sponges. The user can count how many days, months, or weeks it has been using the sponge passed the time period on the sponge.

A user will remove a first sponge from a set of multiple sponges. The first sponge will be the sponge whose indicia is identical to the actual day, month, week or year of the actual use. The sponge will be used until the end of the time period shown on the sponge. The user will identify the time period shown on the sponge. If the time period is past the actual use time period, the first sponge should be replaced with a second sponge from the set of multiple sponges at the end of the time increment indicated on the first sponge. If it is February and the sponge reads January, the January sponge should be replaced with the February sponge, for example. Replacing the sponge based on the time period indicated, at least once a month, will prevent sickness and the spread of harmful bacteria.

It is understood that the system and method described may be used with various types of sponges such as household, cleaning, or cosmetic sponges for example.

The invention has been described in detail with particular reference to certain preferred embodiments thereof, but it will be understood that variations and modifications can be effected within the spirit and scope of the invention.

The invention claimed is:

1. A porous sponge comprising:

a surface of the porous sponge having an identifier that illustrates what time period the sponge is to be used, wherein the identifier is in a month, day, year format.

2. A porous sponge comprising:

a surface of the porous sponge having an identifier in a month, day, year format that can be abbreviated or spelled out fully.

3. A cleaning utensil comprising:

a porous sponge capable of cleaning; and a surface of the porous sponge, wherein the surface of the porous sponge has an identifier in a month, and/or day, and/or year format, such that the identifier further comprises at least one non-numeric symbol so as to convey that the identifier has a timing purpose.

4. The sponge of claim 3, wherein the identifier is a symbol that represents a day, month, week or year.

5. The sponge of claim 3, wherein the identifier is a time period, wherein the time period is the date the sponge should be used or replaced.

* * * * *